US008245794B2

(12) United States Patent
Morris

(10) Patent No.: US 8,245,794 B2
(45) Date of Patent: Aug. 21, 2012

(54) APPARATUS AND METHOD FOR GENERATING SECTOR RESIDENCE TIME IMAGES OF DOWNHOLE TOOLS

(75) Inventor: Stephen A. Morris, Aberdeenshire (GB)

(73) Assignee: Baker Hughes Incorporated, Houston, TX (US)

( * ) Notice: Subject to any disclaimer, the term of this patent is extended or adjusted under 35 U.S.C. 154(b) by 419 days.

(21) Appl. No.: 12/540,072

(22) Filed: Aug. 12, 2009

(65) Prior Publication Data

US 2010/0038137 A1 Feb. 18, 2010

Related U.S. Application Data

(60) Provisional application No. 61/088,990, filed on Aug. 14, 2008.

(51) Int. Cl.
*E21B 47/02* (2006.01)

(52) U.S. Cl. ..... 175/45; 166/250.01

(58) Field of Classification Search ..... 174/45; 166/250.01; 175/45
See application file for complete search history.

(56) References Cited

U.S. PATENT DOCUMENTS

| | | | | |
|---|---|---|---|---|
| 5,277,061 | A | 1/1994 | Draoui | |
| 5,432,699 | A | 7/1995 | Hache et al. | |
| 5,899,958 | A | 5/1999 | Dowell et al. | |
| 6,173,793 | B1 | 1/2001 | Thompson et al. | |
| 7,027,926 | B2 | 4/2006 | Haugland | |
| 7,103,982 | B2 | 9/2006 | Haugland | |
| 7,143,521 | B2 | 12/2006 | Haugland | |
| 7,195,062 | B2 | 3/2007 | Cairns et al. | |
| 7,272,504 | B2 | 9/2007 | Akimov et al. | |
| 7,403,857 | B2 | 7/2008 | Haugland | |
| 2006/0195265 | A1 | 8/2006 | Schen et al. | |
| 2007/0112521 | A1 * | 5/2007 | Akimov et al. | 702/6 |
| 2007/0289373 | A1 | 12/2007 | Sugiura | |
| 2009/0030616 | A1 | 1/2009 | Sugiura | |

* cited by examiner

*Primary Examiner* — William P Neuder
(74) *Attorney, Agent, or Firm* — Cantor Colburn LLP

(57) ABSTRACT

An apparatus and method for providing images of a downhole tool during drilling of a wellbore are provided. A sensor on a rotating tool occupies a number of azimuthal sectors of the wellbore which are determined by a processor. The processor determines a time during which the sensor is in each of the azimuthal sectors during each revolution of the tool and provides a depth-correlated image of the sector residence times for the tool.

21 Claims, 3 Drawing Sheets

200

SRT Data Log (Matrix)

| Depth Points \ Sectors | 1 | 2 | 3 | • • • | m |
|---|---|---|---|---|---|
| 1 | $t_{11}$ | $t_{12}$ | $t_{13}$ | • • • | $t_{1m}$ |
| 2 | $t_{21}$ | $t_{22}$ | $t_{23}$ | • • • | $t_{2m}$ |
| 3 | $t_{31}$ | $t_{32}$ | $t_{33}$ | • • • | $t_{3m}$ |
| ⋮ | | | ⋮ | | |
| n | $t_{n1}$ | $t_{n2}$ | $t_{n3}$ | • • • | $t_{nm}$ |

APPARATUS AND METHOD FOR GENERATING SECTOR RESIDENCE TIME IMAGES OF DOWNHOLE TOOLS

CROSS-REFERENCE TO RELATED APPLICATIONS

This application claims priority from U.S. Provisional Application Ser. No. 61/088,990, filed Aug. 14, 2008.

BACKGROUND OF THE DISCLOSURE

1. Field of the Disclosure

This disclosure relates generally to apparatus and method for providing images relating to drillstring behavior during drilling of wellbores.

2. Description of the Related Art

Wellbores (also referred to as "boreholes") are drilled in the earth's subsurface formations for the production of hydrocarbons (oil and gas). A drill string that includes a drilling assembly (also referred to as a "bottomhole assembly" or "BHA") having a drill bit at the bottom thereof is used for drilling the wellbore. The drillstring and thus the drilling assembly is rotated to drill the wellbore. The drilling assembly typically carries a variety of formation evaluation tools, generally referred to as the logging-while-drilling ("LWD") or measurement-while-drilling ("MWD") tools for estimating various parameters of the formation surrounding the wellbore. Some such tools divide the wellbore into a number of sectors and present the data or image relating to a formation parameter corresponding to each sector. Some other downhole tools (such as mechanical calipers, electrical tools and acoustic tools) provide images of the wellbore inside (i.e. the wall of the wellbore). Some such tools also record the time each sector takes during each revolution. Such time herein is referred to as the sector resident time ("SRT") and the data relating thereto as the SRT data. The SRT data is generally used along with the formation tool measurements to provide images of the wellbore inside. The disclosure herein provides apparatus and methods that utilize the SRT data and provide images of parameters relating to the drilling assembly behavior during drilling of the wellbore and the use of such images to enhance drilling of the wellbore.

SUMMARY OF THE DISCLOSURE

In one aspect, the present disclosure provides a method for providing an image relating to a bottomhole assembly during drilling of a wellbore. The method includes drilling the wellbore by rotating a drill string that carries the bottomhole assembly at an end thereof; dividing an inside circumference of the wellbore into a plurality of sectors; determining a time for which a sensor carried by the drill string spans each sector during each revolution of the bottomhole assembly in the wellbore ("sector residence time"); and providing the image of the sector residence times relating to the bottomhole assembly for a selected wellbore depth.

The image may correspond to a map of the bottomhole assembly rotation in an azimuthal orientation and may be one of: a log of numbers in a suitable unit; a log of residence sector times over depth; and a log of residence sector times over depth showing colors corresponding to the lengths of the sector residence times. The method may estimate from the image a presence of at least one of: a smooth rotation; a railroad rotation; an angular fast-slow movement that does not shift with depth; an uneven rotation; and an uneven rotation with precession. A drill string rotation parameter such as stick slip, whirl, and vibration may also be estimated from the provided image. In one aspect, the image does not include a bottomhole assembly orientation reference.

In one aspect, the sector residence time for a particular sector is determined by stacking sector residence times for the particular sector measured during a plurality of revolutions of the bottomhole assembly. The method may estimate angular velocity of the sectors from the sector residence times and the rotational speed of the bottomhole assembly. The method further comprises altering a drilling parameter for continued drilling of the wellbore based at least in part on the image of the sector residence times. The drilling parameter may include, for example, weight-on-bit; drill string rotational speed; and drilling fluid flow rate through the drill string. In an exemplary embodiment, the sensor is one of: (i) a gamma ray sensor; and (ii) a nuclear sensor.

In another aspect, the present disclosure provides an apparatus for providing an image relating to a bottomhole assembly during drilling of a wellbore. The apparatus includes a drill string that rotates to drill the wellbore; a bottomhole assembly configured to be conveyed into the wellbore at an end of the drill string; and a processor configured to: divide an inside circumference of the wellbore into a plurality of sectors, determine a time for which a sensor carried by the drill string spans each sector during each revolution of the bottomhole assembly in the wellbore ("sector residence time"), and provide the image of the sector residence times relating to the bottomhole assembly for a selected wellbore depth.

In one aspect, the image corresponds to a map of the bottomhole assembly rotation in an azimuthal orientation and may be displayed using one of: a log of numbers in a suitable unit; a log of residence sector times over depth; and a log of residence sector times over depth showing colors corresponding to the lengths of the sector residence times. In another aspect, the processor estimates from the image a presence of at least one of: a smooth rotation; a railroad rotation; an angular fast-slow movement that does not shift with depth; an uneven rotation; and an uneven rotation with precession. The processor may further estimate a drill string rotation parameter from the provided image that is at least one of: (i) stick slip; (ii) whirl; and (iii) vibration. The image may or may not include a bottomhole assembly orientation reference.

The processor may determine the sector residence time for a particular sector in the plurality of sectors by stacking sector residence times for the particular sector measured during a plurality of revolutions of the bottomhole assembly. The processor may also estimate angular velocity of the sectors from the sector residence times and the rotational speed of the bottomhole assembly. The processor may also alter a drilling parameter based at least in part on the image of the sector residence times for continued drilling of the wellbore. The drilling parameter may include one of: (i) weight-on-bit; (ii) drill string rotational speed; and (iii) drilling fluid flow rate through the drill string. The sensor may include at least one of: (i) a gamma ray sensor; and (ii) a nuclear sensor.

In another aspect, the present disclosure provides a computer-readable medium product having stored thereon instructions which when read by at least one processor perform a method. The method includes dividing an inside circumference of the wellbore into a plurality of sectors; determining time for which a sensor carried by a rotating drill string spans each sector during each revolution of a bottomhole assembly conveyed in the wellbore on a rotating drill string ("sector residence time"); providing an image of the sector residence times relating to the bottomhole assembly for a selected wellbore depth; and recording the image on a suitable medium. In one aspect, the computer-readable medium includes at least one of (i) a RAM, (ii) a ROM, (iii) an EPROM, (iv) an EAROM, (v) a flash memory, and (vi) an optical disk.

Examples of only certain features of the methods and apparatus of generating sector resident time images have been summarized rather broadly in order that the detailed description thereof that follows may be better understood and in order that the contributions they represent to the art may be appreciated. There are, of course, additional features of the disclosure that will be described hereinafter and which will form the subject of any claims that may be made.

BRIEF DESCRIPTION OF THE DRAWINGS

For detailed understanding of the various features of the apparatus and methods for generating SRT images, reference should be made to the following detailed description, taken in conjunction with the accompanying drawing in which like elements are generally designated by like numerals and wherein.

DETAILED DESCRIPTION OF THE DISCLOSURE

Figure 1:
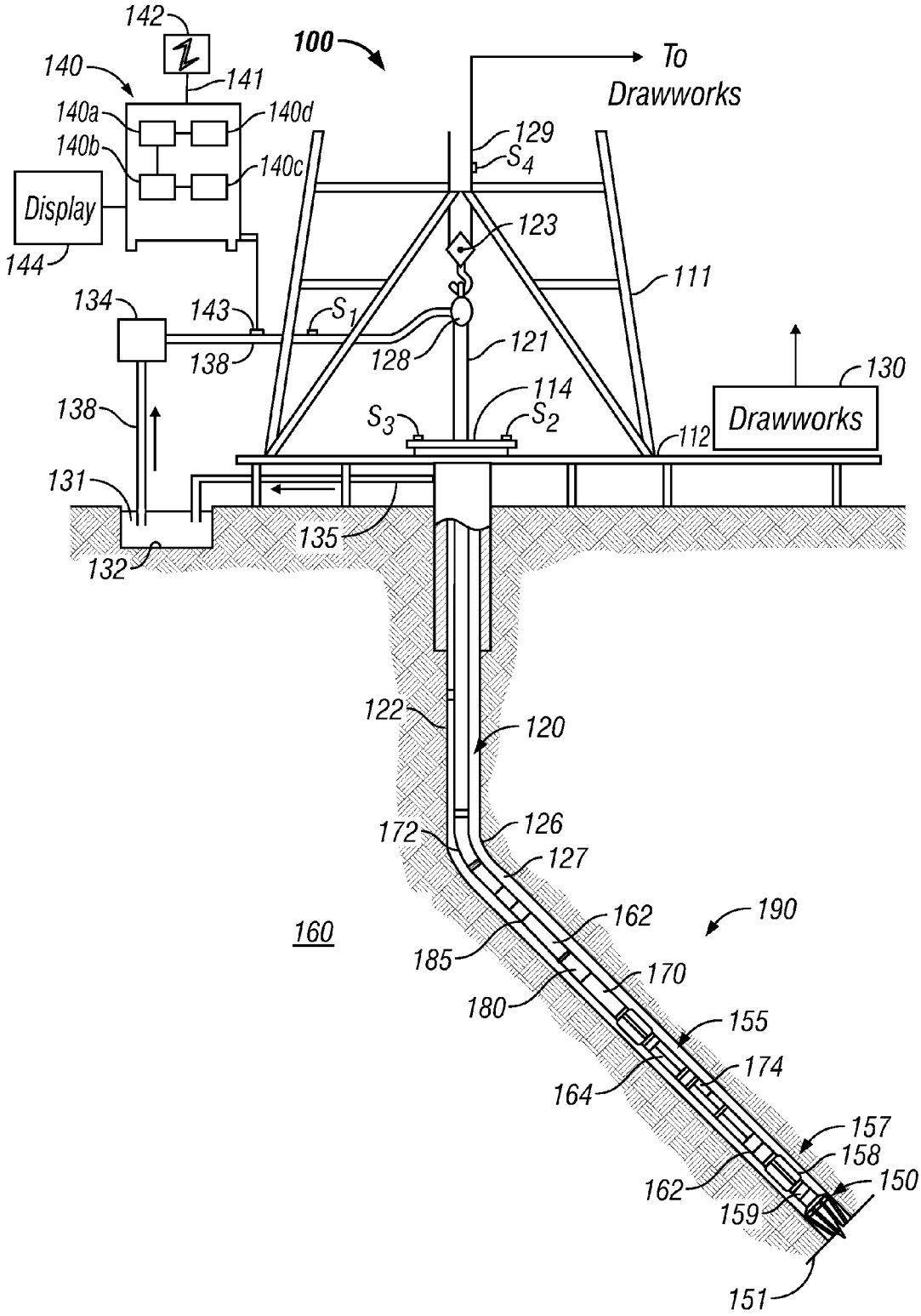
FIG. 1 is a schematic illustration of an exemplary drilling system that includes a drilling assembly that carries a tool for providing SRT images according to one embodiment of the disclosure.

FIG. 1 shows a schematic diagram of a drilling system 100 for drilling a wellbore 126 in an earth formation 160 and for estimating properties or characteristics of interests of the formation 160 during the drilling of the wellbore. The drilling system 100 includes a drill string 120 that comprises a drilling assembly or BHA 190 attached to a bottom end of a drilling tubular (drill pipe) 122. The drilling system 100 is shown to include a conventional derrick 111 erected on a floor 112 that supports a rotary table 114, which is rotated by a prime mover, such as an electric motor (not shown) to rotate the drilling tubular 122 at a desired rotational speed. The drilling tubular 122 typically includes jointed metallic pipe sections and extends downward from the rotary table 114 into the wellbore 126. A drill bit 150, attached to the bottom end of the BHA 190, disintegrates the geological formations when the drill bit is rotated. The drill string 120 is coupled to a drawworks 130 via a Kelly joint 121, swivel 128 and line 129 through a pulley 123. During the drilling of the wellbore 126, draw works 130 controls the weight-on-bit ("WOB"), which affects the rate of penetration ("ROP") of the drill bit into the formation 160.

To drill the wellbore 126, a suitable drilling fluid or mud 131 from a source or mud pit 132 is supplied under pressure to the drill string 120 by a mud pump 134. The drilling fluid 131 passes from the mud pump 134 into the drilling tubular 122 via a fluid line 138. The drilling fluid 131 discharges at the wellbore bottom 151 via suitable openings at the bottom of the drill bit 150. The drilling fluid 131 returns to the surface via the annulus (annular space) 127 between the drill string 120 and the wellbore 126 and then to the mud pit 132 via a return line 135. A sensor $S_1$ in the line 138 provides measurements relating to the flow rate of the fluid 131. A surface torque sensor $S_2$ and a sensor $S_3$ associated with the drill string 120 respectively provide information about the torque and the rotational speed of the drill string. Additionally, one or more sensors (collectively referred to as $S_4$) associated with line 129 may be utilized to provide the hook load of the drill string 120 and information about other parameters relating to the drilling of the wellbore 126.

In certain applications, the drill bit 150 is rotated by only rotating the drill pipe 122. However, in other applications, a drilling motor 155 (also referred to as the "mud motor") disposed in the drilling assembly 190 may be used to rotate the drill bit 150 and/or to superimpose or supplement the rotational speed of the drill string.

The drilling system 100 further may include a surface control unit 140 configured to provide information relating to the drilling operations and to control certain desired drilling operations. In one aspect, the surface control unit 140 may be a computer-based system that includes one or more processors (such as microprocessors) 140*a*, one or more data storage devices 140*b* (such as solid state-memory, hard drives, tape drives, etc.), display units and other interface circuitry 140*c*. Computer programs and models 140*d* for use by the processors 140*a* may be stored in the data storage devices 140*b* or any other suitable data storage device. The surface control unit 140 also may interact with one or more remote control units 142 via any suitable data communication link 141, such as the Ethernet and the Internet. In one aspect, signals from the downhole sensors and devices (described later) are received by the control unit 140, via one or more via sensors, such as sensors 143 or via direct links, such as electrical conductors, fiber optic links, wireless links, etc. The surface control unit 140 processes the received data and signals according to programs and models 140*d* and provides information about drilling parameters (such as WOB, RPM, fluid flow rate, hook load, etc.) and formation parameters (such as resistivity, acoustic properties, porosity, permeability, etc.). The surface control unit 140 records such and other information of interest on suitable data storage devices and displays information relating to certain desired drilling parameters and any other selected information on a display 144, which information may be utilized by the control unit 140 and/or a drilling operator at the surface to control one or more aspects of the drilling system 100, including drilling the wellbore along a desired profile (also referred to as "geosteering").

Still referring to FIG. 1, BHA 190, in one aspect, may include a force application device 157 that may contain a plurality of independently-controlled force application members 158, each of which may be configured to apply a desired amount of force on the wellbore wall to alter the drilling direction and/or to maintain the drilling of the wellbore 126 along a desired path. A sensor 159 associated with each force application member 158 provides signals relating to the force applied by its associated member. The drilling assembly 190 also may include a variety of sensors (collectively designated herein by numeral 162) located at selected locations on the drilling assembly that provide information about the various drilling assembly operating parameters, including but not limited to: bending moment, stress, vibration, stick-slip, tilt, inclination and azimuth. Accelerometers, magnetometers and gyroscopic devices (collectively referred to as position sensors and designated by numeral 174) are utilized for estimating inclination, azimuth and tool face position of the drilling assembly 190. In one aspect, a controller 170 carried by the drilling assembly processes the signals from the various sensors 162 and calculates in-situ the values of the drilling assembly operating parameters using programs and models provided to the downhole control unit 170. In another aspect, the sensor signals may be partially processed downhole by the downhole control unit 170 and then sent to the surface controller 140 for further processing.

Still referring to FIG. 1, the BHA 190 may further include any number of desired MWD devices or tools (collectively referred to by numeral 164) for estimating or determining various properties of the formation 160. Such tools may include resistivity tools, acoustic tools, nuclear magnetic resonance (NMR) tools, gamma ray tools, nuclear logging tools, formation testing tools and other desired tools. Each such tool may process signals and data according to programmed instructions and provide information about certain properties of interest of the formation. The BHA 190 further includes a telemetry unit 172 that establishes a two-way data communication between the devices in the BHA and a surface device, such as the surface control unit 140. Any suitable telemetry system may be used for the purpose of this disclosure, including, but not limited to, mud pulse telemetry, acoustic telemetry, electromagnetic telemetry, and wired-pipe telemetry. The wired-pipe telemetry may include: (i) a drill pipe that may be made of drill pipe sections (jointed tubulars) in which electrical conductors or fiber optic cables are run along individual drill pipe sections and wherein communication among the pipe sections is established by any suitable method, including, but not limited to, mechanical couplings, electromagnetic couplings, fiber optic couplings, acoustic couplings, or wireless communication across pipe joints or pipe sections; or (ii) a coiled tubing in which electrical wires or optical fibers are run along the length of the tubing. While the drilling system 100 described thus far is a land-based system, the apparatus and methods described herein are equally applicable to offshore drilling systems.

Still referring to FIG. 1, the BHA 190, in one aspect, includes an MWD tool 180 for providing SRT data or SRT images of the BHA 190 during drilling of a wellbore. In one aspect, the tool 180 may include one or more sensors that provide information about the angular velocity of the BHA and determine therefrom the sector resident time for each sector relative to a selected reference point on the BHA 190, such as the high side of the BHA 190, which may be determined from the sensors 174. The SRT data may be provided in an analog or a digital form correlated with the wellbore depth. The term "depth" as used herein means the location of a point in the wellbore relative to a reference point, such as the surface or another point in the drill string. The operation of the tool 180 and the generation of an SRT data and SRT images are described in more detail in reference to FIGS. 2-5.

Figures 2, 3:
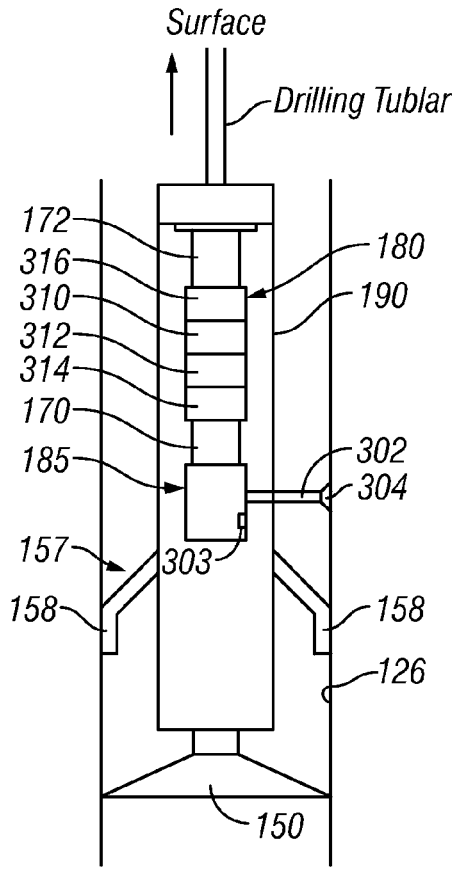
FIG. 2 shows a data matrix that contains synthetic sector resident times for each sector for a selected wellbore depth.
FIG. 3 shows a block diagram of a downhole tool for generating SRT images according to one embodiment of the disclosure.

FIG. 2 depicts an SRT data matrix or log 200 that is shown to contain digital SRT data corresponding to "m" sectors (horizontal direction) and "n" depth points (vertical direction). In FIG. 2, a value "$t_{ij}$" represents the SRT data for depth point "i" and sector "j." For example, the data designated as $t_{23}$ is the resident sector time for the depth point 2 and sector 3. The creation of the SRT matrix 200 and its use for generating SRT images is described later in reference to FIGS. 3-5.

FIG. 3 is a functional block diagram showing certain features of the tool 180. FIG. 3 also shows an image tool 185 and the steering device 157 having a plurality of force application members 158 for steering the drill bit 150 along any desired direction. The image device 185 may be any suitable measurement-while-drilling (MWD) tool 304 (also referred to as logging-while-drilling (LWD) tool), including, but not limited to, a nuclear imaging tool and an electrical tool, and an acoustic tool. Arm 302 may extend the MWD tool 304 from the image tool 185. The downhole controller 170 and/or the surface controller 140 may process the signals or data provided by the tool 185.

The tool 185 may further include a sensor 303 that provides signals relating to the angular velocity of the rotation of the tool 185. The controller 170 also receives information about the number of sectors in which the tool azimuth has been divided, such as 8, 16, 32, 120 sectors or another suitable number of sectors. The controller 170 also receives information about the reference point, such as the high side of the tool 185. The controller 170 generates therefrom the resident sector time data for each sector. In one aspect, the resident sector time for each sector corresponding to given depth may be an accumulated or averaged time recorded over several BHA rotations. As an example, assume that the drill bit rate of penetration is 100 meters per hour, the tool's RPM is 100, and each depth point corresponds to 5 centimeters. In this example, the tool will penetrate the earth at a rate of about 2.778 centimeters per second and the number of revolutions will be 1.667 per second. Therefore, for each depth point the segment time may be accumulated or averaged over $(5/2.778)\times1.6667=3.000$ revolutions. The SRT data may be stored in a suitable data storage device in the form shown in FIG. 2. In one aspect, the SRT data may be processed downhole by the tool 180 or sent to the surface for processing by the surface controller 140 or a combination thereof as described below.

The tool 180, in one aspect, may include a processing unit that includes a processor 310, which may be a microprocessor, a data storage device 312, such as a solid-state-memory, one or more computer programs and models 314 that are stored in the data storage device 312 and for accessible to the processor 310 to perform the functions disclosed herein. The tool 180 also may include any other circuitry 316 desired for use in generating sector resident times and corresponding images therefrom.

Figure 4:
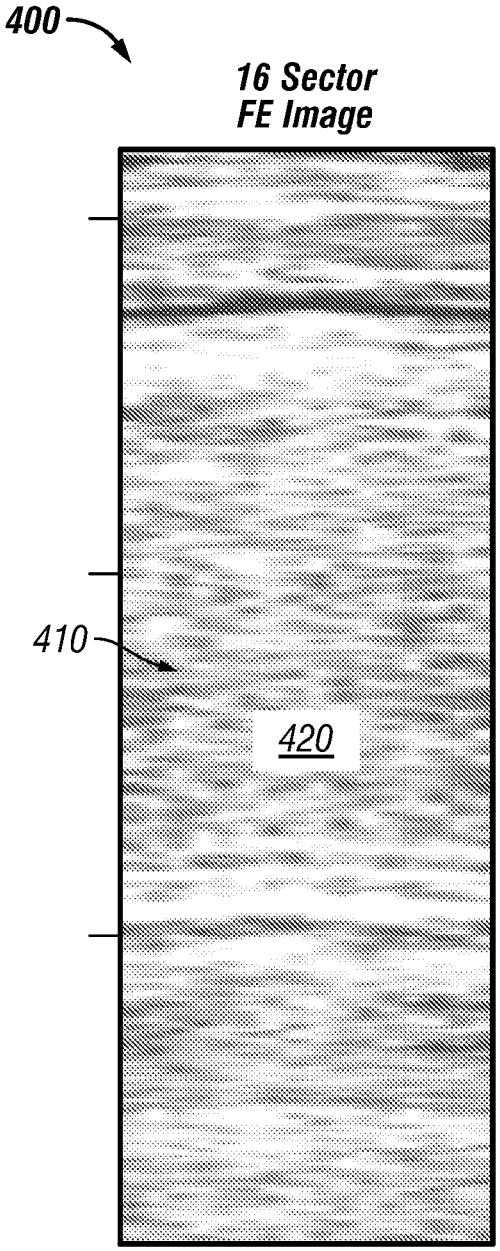
FIG. 4 is an exemplary image of a formation property.

In operation, the tool 185 may generate a suitable image of the wellbore, such as an image 400 shown in FIG. 4. The position of the tool 185 in the wellbore, including the tool face, may be obtained from the tool 174 during drilling of the wellbore. The depth data may be sent from the surface by any suitable telemetry method. The processor 310 utilizing the depth data and the SRT data may generate an SRT image, such as image 500 shown in FIG. 5. In one aspect, the processor 310 may store the SRT data in the downhole data storage device 312 and/or send such data to the surface via the telemetry unit 172. Alternatively, the SRT data may be transmitted to the surface, wherein the controller 140 processes such data to generate the SRT image 500. In another aspect, the SRT data may be partially processed downhole by the processor 310 and partially by the surface controller 140 for generating the SRT images.

Figure 5:
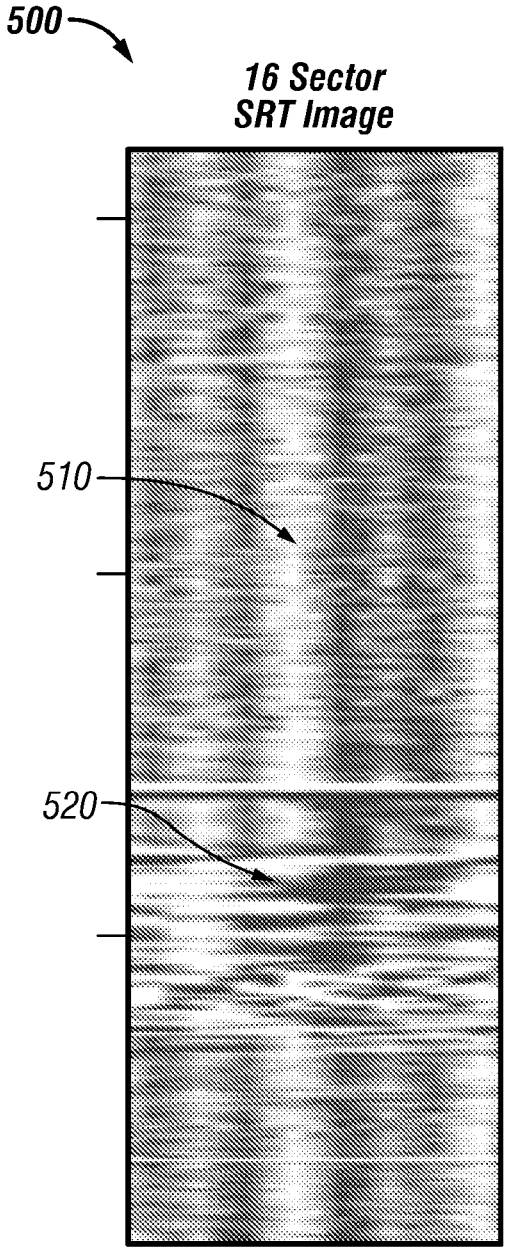
FIG. 5 shows an exemplary SRT image that may be generated according to one aspect of the disclosure.

An exemplary SRT image 500 that corresponds to the wellbore image 400 is shown in FIG. 5. The wellbore image 400 shows a regular or relatively smooth wellbore wall section at location 410 and a substantially irregular wall section at location 420. The image 500 shows an erratic tool behavior at section 520 and a relatively smooth behavior at section 510. The erratic behavior may be due to a physical phenomenon, such as stick-slip or wobble of the BHA 190. In one aspect, the image may be scaled so that low angular velocities are colored bright while the high angular velocities are colored dark (or vice versa). Alternatively, different colors may be used to distinguish sector residence time and/or angular velocities. Thus, the resulting image 500 is a continuous image of the rotation of the BHA 190 versus depth generated during drilling of the wellbore. The drill string or BHA 190 angular velocity in its non-dimensional azimuth within the wellbore. Furthermore, several image patterns may be observed, including, but not limited to, smooth rotation, railroad rotation with angular fast-slow movement that does not shift/presses with depth, uneven rotation, and uneven rotation with possible precession. Therefore, SRT image logs may provide one or more in-situ observations of the BHA behavior, which may be utilized automatically or by a rig-side operator to alter one or more drilling parameters to increase drilling efficiency and enhance BHA life.

Therefore, in one aspect, the controller 170 and/or controller 140 or a rig operator at the surface may take one or more actions based at least in part on the SRT image 500 to reduce a detrimental impact on the drilling operations. In one aspect, the action may include altering a drilling parameter, including, but not limited to, altering WOB, fluid flow rate into the drill string, and RPM of the mud motor and/or the drill string. In another aspect, the controller 170 may alter the force applied by one or more force application members 158 to control the drilling direction ("geosteering"). Altering one or more such parameters may improve the rate of penetration and/or increase the life of the BHA 190 and/or the drill bit 150.

In view of the above, a method for generating information relating to a parameter of a downhole tool during drilling of the wellbore may include: drilling the wellbore by rotating a drill string that carries the bottomhole assembly at an end thereof; dividing tool azimuth or wellbore inside into a plurality of sectors; determining a sector resident time (the time for which a sensor carried by the drill string spans each sector) for individual sectors corresponding to a plurality of depth points; and generating an image relating to the parameter using the sector residence times.

The sector resident time for a particular sector may be obtained by accumulating or averaging the sector resident time of such sector over more than one revolution of the bottomhole assembly. The sector resident time image may be displayed in any suitable form, including as a log of numerical values for a selected wellbore depth, or a visual image representation (in gray scale or colors). The colors may be scaled from a light or bright color for a low angular velocity to a dark color for a high angular velocity or vice versa. Alternatively, different colors may be utilized for visually expressing different features of the drillstring or BHA 190 behavior. The disclosure herein is provided in reference to a BHA. The disclosure, however, applies equally to any other downhole tool, including the BHA.

The method may further provide an image of the formation surrounding the wellbore using: a gamma ray sensor; an electrical sensor, resistivity sensor, an acoustic sensor, or a density sensor. The sector resident time image or the data may be utilized to estimate any number of parameters relating to the downhole tool. In one aspect, the parameter may include one or more of: (i) stick slip; (ii) whirl; and (iii) vibration. In another aspect, the method provides for estimating from the SRT image the presence of at least one of: smooth rotation; railroad rotation; with angular fast-slow movement that does not shift with depth; uneven rotation; and uneven rotation with precession.

In another aspect, the method provides for estimating from the SRT time data one or more anomalies or behavior characteristics of the BHA 190 or another tool carried by the BHA 190. In another aspect, the method may include altering a parameter of interest (a parameter or characteristic) based at least in part on the estimated behavior of the BHA 190 or a tool carried by the BHA 190. The parameter of interest may be a drilling parameter, including, but not limited to weight-on-bit, hook load, drill string rotational speed, mud motor rotational speed, drilling fluid flow rate through the drill string and/or the drilling direction. The drilling direction may be altered by altering the force applied on the wellbore wall by one or more of the force application members. In one aspect, the sector residence image may not include a downhole tool orientation reference.

In another aspect, an apparatus made according to the disclosure may include a downhole tool that includes a sensor that provides information about residence time for a number of sectors of a tool during drilling of a wellbore and a processor that creates an image of the sector residence times. The sector residence time image provides information about the behavior of the tool in the wellbore during drill, including stick slip and whirl. A processor associated with the apparatus may alter a drilling parameter, including weight-on-bit, fluid flow rate into the wellbore, rotational speed of a downhole motor and/or the drill string, hook load, and/or drilling direction. The tool may include a telemetry unit that is configured to provide two-way communication with the surface.

In another aspect, a computer-readable medium according to the disclosure may have stored thereon instructions which when read by at least one processor perform a method to divide an inside circumference of a wellbore into a plurality of sectors, determine a sector residence time for a number of sectors of a tool during drilling of the wellbore, provide an image of the sector residence times relating to the bottomhole assembly for a selected wellbore depth, and record the image on a suitable medium. The computer-readable medium may include a RAM, a ROM, an EPROM, an EAROM, a flash memory, and an optical disk.

What is claimed is:

1. A method of determining a parameter relating to a downhole tool during drilling of a wellbore, comprising:

defining a plurality of sectors relating to the downhole tool;

estimating time taken by a sensor to span a sector in the plurality of sectors during rotation of the downhole tool in the wellbore ("sector residence time");

providing an image of the sector residence times for the plurality of sectors; and determining the parameter of the downhole tool utilizing the provided image of the sector residence times.

2. The method of claim 1 wherein providing the image further comprises displaying the image as one of: (i) a log of numbers in a suitable unit; (ii) a log of residence sector times over depth; and (iii) a log of residence sector times over depth showing colors corresponding to the estimated sector residence times.

3. The method of claim 1, wherein the sensor is at least one of: (i) a gamma ray sensor; and (ii) a nuclear sensor.

4. The method of claim 1, wherein the determined parameter is at least one of: (i) stick-slip; (ii) whirl; and (iii) vibration.

5. The method of claim 1 further comprising displaying an image of the downhole tool relating to the parameter.

6. The method of claim 1 further comprising altering a drilling parameter for continued drilling of the wellbore based at least in part on the estimated sector residence times.

7. The method of claim 6, wherein the drilling parameter is at least one of: (i) weight-on-bit; (ii) drill string rotational speed; (iii) drilling fluid flow rate through the drill string; and (iv) rotational speed of the downhole tool.

8. The method of claim 1 further comprising estimating at least one of: angular velocity of the plurality of sectors; and rotational speed of the downhole tool.

9. The method of claim 1 further comprising estimating from the sector residence times at least one of: a smooth rotation; a railroad rotation; an angular fast-slow movement that does not shift with depth; an uneven rotation; and an uneven rotation with precession.

10. The method of claim 5, wherein the image is independent of downhole tool orientation reference.

11. An apparatus for use in a wellbore, comprising:

a downhole tool configured to be conveyed into the wellbore at an end of a drill string;

a storage device containing information about a plurality of sectors relating to the downhole tool; and a processor configured to:

estimate time taken by a sensor to span a sector in the plurality of sectors during rotation of the downhole tool in the wellbore ("sector residence time"), and provide an image of the sector residence times for the plurality of sectors.

12. The apparatus of claim 11, wherein the processor is further configured to estimate the sector residence time for a particular sector in the plurality of sectors by stacking sector residence times for the particular sector measured during a plurality of revolutions of the downhole tool.

13. The apparatus of claim 11, wherein the processor is further configured to provide the image as one of: (i) a log of numbers in a suitable unit; (ii) a log of residence sector times over depth; and (iii) a log of residence sector times over depth showing colors corresponding to the lengths of the sector residence times.

14. The apparatus of claim 11, wherein the sensor is at least one of: (i) a gamma ray sensor; and (ii) a nuclear sensor.

15. The apparatus of claim 11, wherein the processor is further configured to provide information about altering a drilling parameter based at least in part on the sector residence times for continued drilling of the wellbore.

16. The apparatus of claim 11, wherein the image corresponds to a map of the downhole tool rotation in an azimuthal orientation.

17. The apparatus of claim 15, wherein the drilling parameter is at least one of: (i) weight-on-bit; (ii) drill string rotational speed; and (iii) drilling fluid flow rate through the drill string.

18. The apparatus of claim 11 wherein the processor is further configured to estimate a drill string rotation parameter from the image that is at least one of: (i) stick slip; (ii) whirl; and (iii) vibration.

19. The apparatus of claim 11 wherein the processor is further configured to estimate angular velocity of the sectors from the sector residence times and the rotational speed of the downhole tool.

20. The apparatus of claim 11 wherein the processor is further configured to estimate from the image a presence of at least one of: a smooth rotation; a railroad rotation; an angular fast-slow movement that does not shift with depth; an uneven rotation; and an uneven rotation with precession.

21. A computer-readable medium having stored thereon instructions which when used by at least one processor performs a method, the method comprising:

defining a plurality of sectors related to a downhole tool;

estimating time taken by a sensor to span a sector of the plurality of sectors during rotation of the downhole tool in the wellbore ("sector residence time"); and providing an image of the sector residence times for the plurality of sectors.

* * * * *